United States Patent [19]

Rynik

[11] 4,326,753

[45] Apr. 27, 1982

[54] ADVANCE MECHANISM, PREFERABLY FOR MINING MACHINES

[76] Inventor: Jan Rynik, ul. Kalinowa 16, Gliwice, Poland

[21] Appl. No.: 158,586

[22] Filed: Jun. 11, 1980

[30] Foreign Application Priority Data

Jun. 12, 1979 [PL] Poland ..... 216335

[51] Int. Cl.[3] ..... E21C 29/02

[52] U.S. Cl. ..... 299/43; 105/29 R

[58] Field of Search ..... 219/42, 43; 105/29 R

[56] References Cited

U.S. PATENT DOCUMENTS

| | | | |
|---|---|---|---|
| 4,103,975 | 8/1978 | Funke | 299/43 |
| 4,155,600 | 5/1979 | Lanfermann | 299/43 |
| 4,162,810 | 7/1979 | Oberste-Beulmonn | 299/43 |
| 4,184,715 | 1/1980 | Lanfermann | 299/43 |
| 4,186,970 | 2/1980 | Minke | 299/43 |

*Primary Examiner*—William F. Pate, III

[57] ABSTRACT

A rack for mounting on a segmented mine wall face conveyor and for assisting the movement of a drum mining machine along the conveyor, the rack comprising a series of rack segments aligned substantially in an end-to-end relationship, each rack segment provided with a plurality of equidistantly spaced pins adapted for driving engagement with a pinion of the drum mining machine, each segment rotatably mounted on the conveyor, and adjacent rack segments rotatably joined together by a connection link. Means are disclosed for extending and contracting the connection link relative to each adjacent rack segment, and means are disclosed for maintaining the rack at a relatively constant position relative to the pinion in the region of engagement with the pinion.

8 Claims, 12 Drawing Figures

ADVANCE MECHANISM, PREFERABLY FOR MINING MACHINES

The subject of the invention is an advance mechanism preferably for mining machines like winning and loading machines as well as underground and surface railways.

The known designs of various advance mechanisms are equipped with one drive wheel meshing with a rack rigidly fastened to a travel route of the machine. Rack segments possess toothing, sockets or pins positioned between two strips for mating with toothing, catches or similar drive elements.

The principal drawback of known constructions of advance mechanisms with rack segments fastened rigidly to a travel route of the machine is their defective operation on curved routes. A drive wheel of an advance mechanism, on curved segments of a route, assumes an oblique position in relation to the rack and upon engaging curved, continuous rack segments, a considerable increase of pitch length occurs. Serious problems of mating between the drive wheel and the rack occur on curves because of the oblique position of the wheel in relation to a lengthwise axis of the rack and changes of pitch length on contacts of a conveyor trough, limit considerably the range of application of such mechanisms and they are sources of numerous breakdowns and low durability of a rack and a drive wheel.

There is also disclosed in Polish patent application No. P. 206,703 a construction possessing segments fastened alternately rigidly or jointly to a travel route of a machine.

Every second element of the rack, positioned above the connection of conveyor troughs, has the capacity to move lengthwise for a limited distance, obtained by equipping it with two jointed holders fastened in oval openings of a casing of a conveyor rack. The disadvantage of this construction is defective mating of a drive wheel with a rack on a curved route, especially in horizontal plane, caused by the change of position of the drive wheel axis in relation to a lengthwise axis of rack segments. On a straight line route, in this construction, a change of position of the wheel in relation to its normal position occurs also, in a range of plays between a skid of a machine and strips of the rack, which deteriorates mating of the wheel with the rack in normal conditions of operation.

Polish Pat. No. 104,524 discloses another construction of an advance mechanism wherein rack segments are articulatingly fastened to a travel route by means of a fork shaped holder allowing for turning and cross movement and for raising and lowering of a rack segment on a slidable connecting pin of the fork with a footing fastened to the travel route of the machine.

Another construction is disclosed in Polish patent application No. P. 194,151 wherein rack segments are articulatingly fastened to a travel route of the machine by means of two joints connected by a guide.

The disadvantage of the above-mentioned construction of advance mechanisms having an articulated manner of fastening rack segments is the considerable weight of the racks and the difficult assembling and dissassembling of the component elements. Additional disadvantages of the construction according to U.S. Pat. No. 104,524 are the rather large width of the fork shaped holder and the complicated shaping of strips of rack segments, while an additional disadvantage of the construction according to the patent application No. P. 194,151 is the location of an axis of a joint below a lengthwise axis of a rack, which causes rotary momentum in the guide of a machine, which in turn increases frictional drag.

The purpose of the present invention is to design an advance mechanism which overcomes the above-mentioned disadvantages of the prior art advance mechanisms.

An advance mechanism, preferably for mining machines, includes a drive wheel for mating with a rack comprising rack segments connected jointly in a chain, which segments are fastened to the travel route of the machine by means of a holder, wherein the distance between the axis of rotation of the drive wheel and the longitudinal axis of the rack is constant and independent of the kind and degree of curvature of the travel route of the machine.

A holder having an upper work surface for mating with the drive wheel and fastened to the rack segments may ride over a slide guide, thereby maintaining a constant position of the drive wheel relative to the lengthwise axis of the rack. The present invention also provides that connectors join together rack segments. The connectors are provided with pins extending through oval openings which allow pin movement along the longitudinal axis of the rack and which allow for quadruple decrease of maximal pitch length on curved portions of the travel route and which thereby promote correct mating of the drive wheel and the rack. The present invention also provides that connectors join together rack segments. The connectors are provided with pins extending through oval openings which allow pin movement along the longitudinal axis of the rack and which allow for quadruple decrease of maximal pitch length on curved portions of the travel route and which thereby promote correct mating of the drive wheel and the rack. The above-described features of the present invention thus overcome the disadvantages associated with the previously mentioned prior advance mechanisms.

The advance mechanism of the present invention provides constant positioning of the axis of rotation of the drive wheel in relation to the lengthwise axis of the rack segments, independently on the kind and degree of curvature of the travel route of the machine.

The subject advance mechanism is simple to construct and use due to the simplicity of the rack segments, holders, and guides. Furthermore, the advance mechanism is relatively inexpensive to manufacture and is reliable and quiet in operation in various mining conditions.

The construction of the present advance mechanism also permits the drive wheel to be oriented vertically as well as horizontally.

An embodiment of the invention will now be described, by way of example, with reference to the accompanying drawings, in which.

Figure 1:
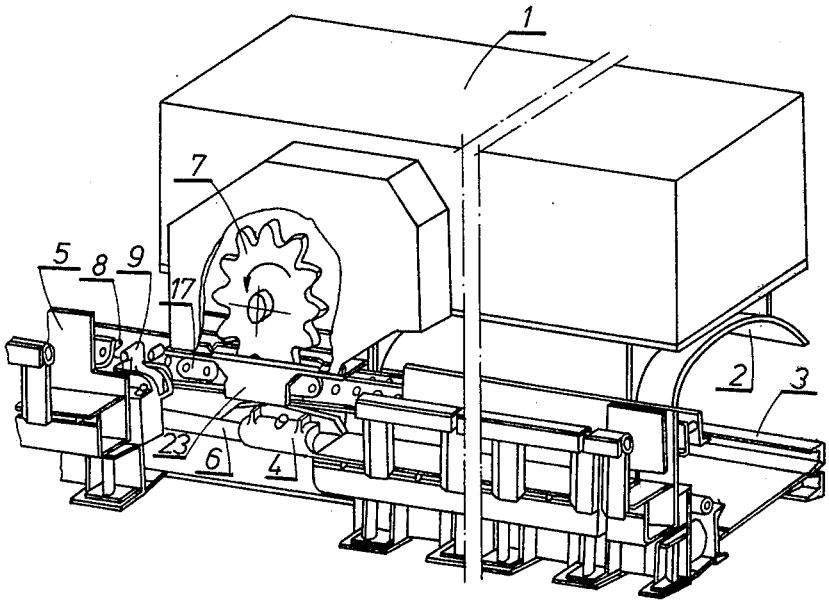
FIG. 1 is a perspective view of an advance mechanism according to the present invention partially cut away to show a drive wheel mounted with a horizontal axis of rotation.
Figure 2:
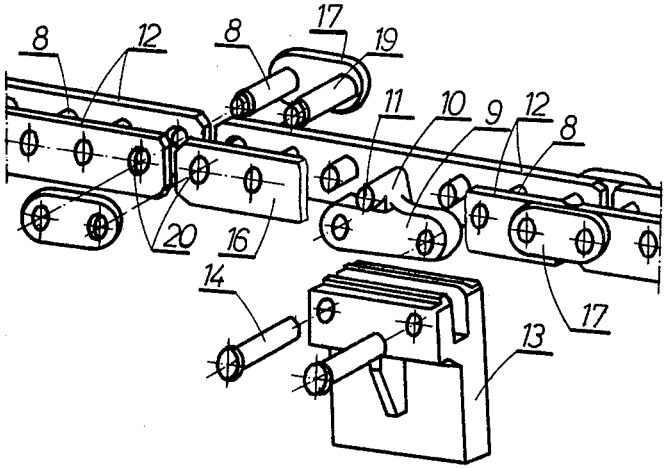
FIG. 2 is a partially exploded, perspective view of a rack partially cut away to show a holder and a support guide according to the present invention.
Figure 3:
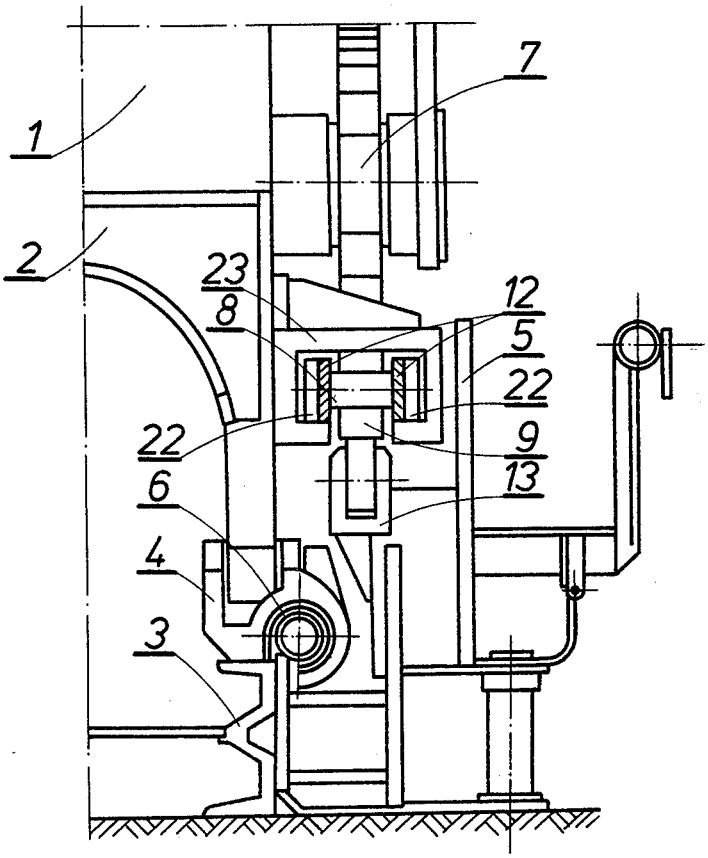
FIG. 3 is a cross-sectional view of the advance mechanism shown in FIG. 1, showing the travel route of the mining machine.
Figure 4:
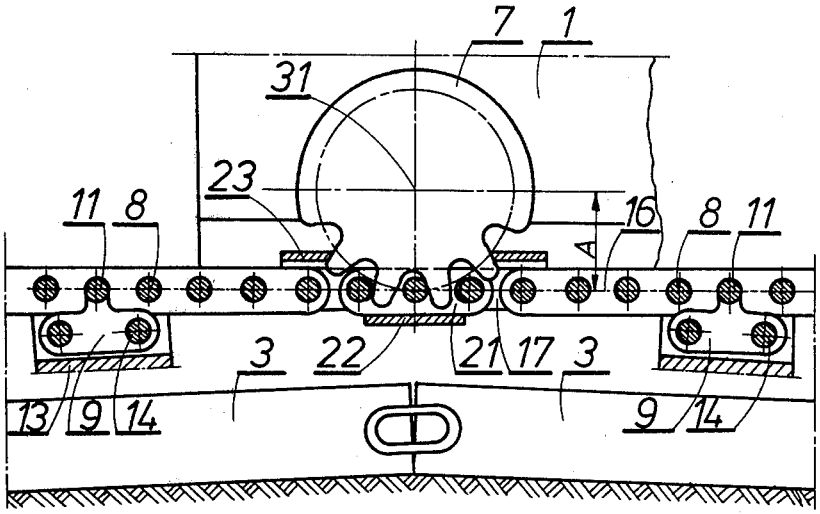
FIG. 4 is a diagrammatic side view of a drive wheel, rack, holder and support guide according to the present invention on a vertically curved portion of the travel route of the mining machine.
Figure 5:
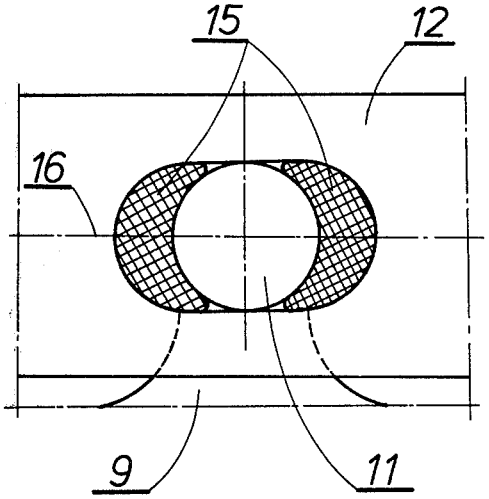
FIG. 5 is a side view of a rack strip having a side opening in which a pair of flexible inserts are disposed, one insert on each longitudinal side of a pin extending therethrough, according to the present invention.
Figure 6:
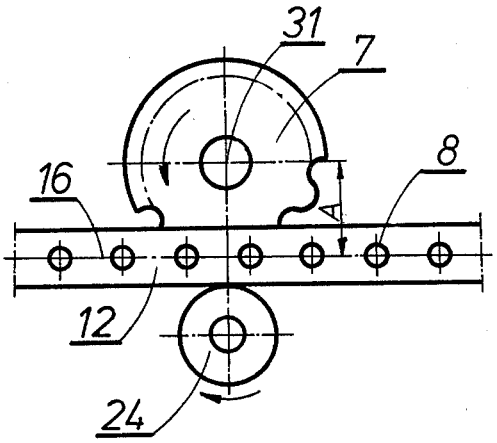
FIG. 6 is a diagrammatic side view of the drive wheel, rack and rotary support disk according to the present invention.
Figure 7:
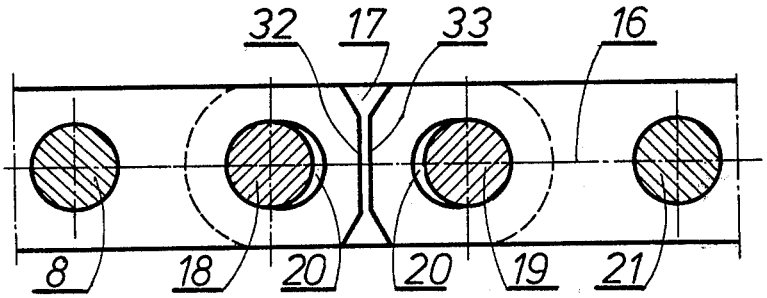
FIG. 7 is a side view of two rack segments joined together by a connector according to the present invention.
Figure 8:
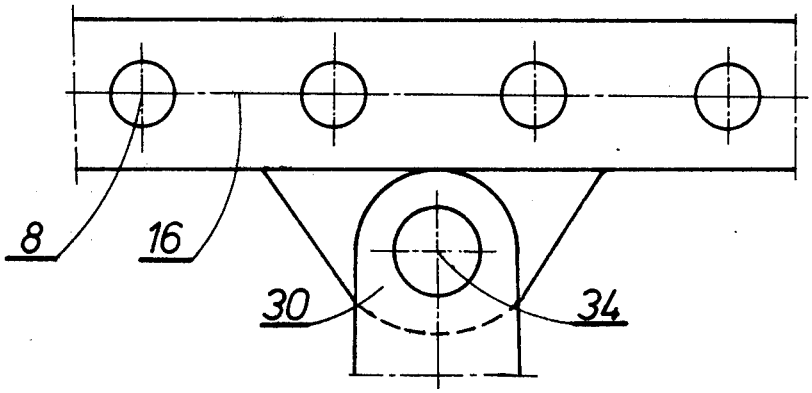
FIG. 8 is a side view of a rack segment with a holder depending below tthe rack according to the present invention.
Figure 9:
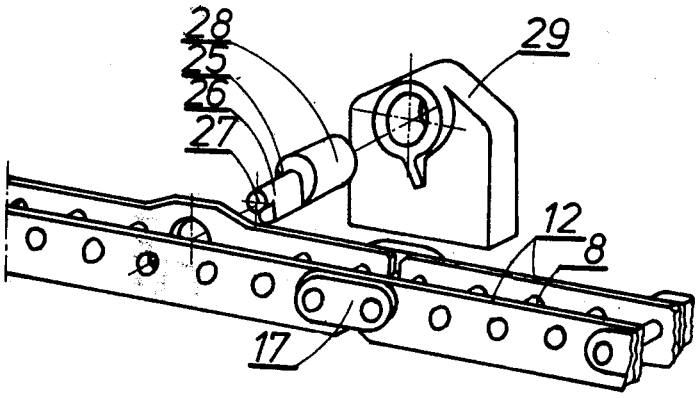
FIG. 9 is a partly exploded, perspective view of a rack segment with a holder attached to the side of the rack according to the present invention.
Figure 10:
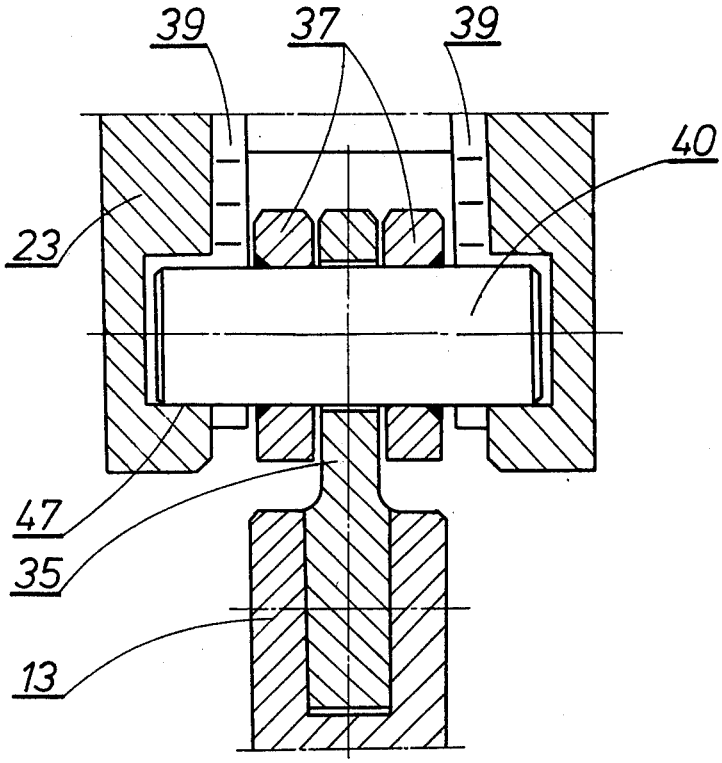
FIG. 10 is a cross-sectional view of a rack, a holder pinned thereto, and a support guide according to the present invention.
Figure 11:
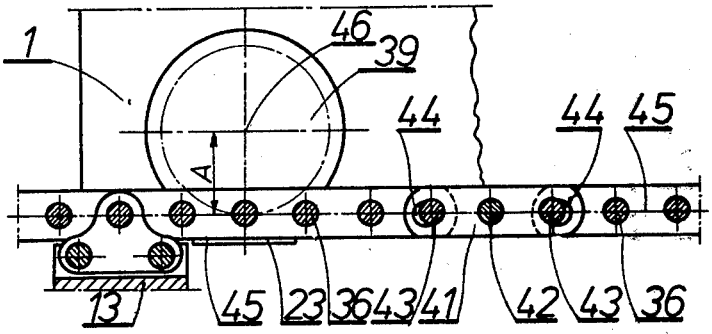
FIG. 11 is a diagrammatic side view of a drive wheel, rack, holder, and support guide according to the present invention.
Figure 12:
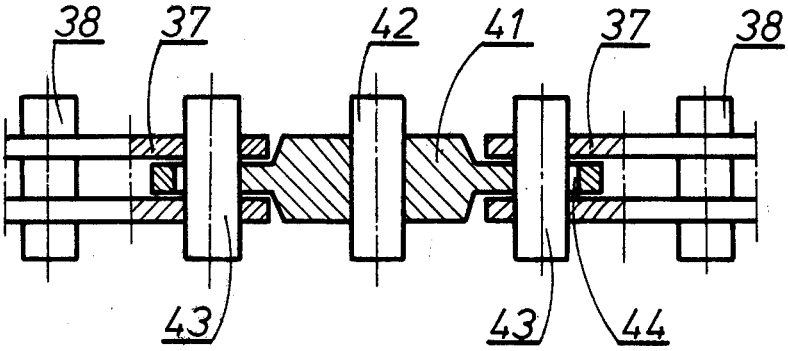
FIG. 12 is a top view in partial cross section of a connector joining rack segments in the rack shown in FIG. 11.

The advance mechanism is equipped with the drive wheel 7, driven by a drive transmission of the machine 1. The drive wheel meshes with segments of the rack 8 in the form of pins, fastened to two side strips 12. The segments of the rack 8 are jointly fastened to a travel route 3 of the machine 1, which route consists of conveyor troughs, the guide pipe 6, the spill plate 5 and the skid 4, fastened to the saddle 2 of the machine 1. The segments of the rack 8 assume constant position towards the drive wheel 7, such position being maintained by the guide, which embraces the drive wheel 7. Constant distance A between the lengthwise axis 16 of the segments of the rack and the axis of rotation 31 of the toothed drive wheel 7 is maintained by the buffering surfaces 22 of the guide 23 independently of the kind and degree of curving of the travel route of the machine 1.

The holder, fastening jointly the segment of the rack 9 to the travel route of the machine 1, possesses work surface 10 for mating with the drive wheel 7 and a pin 11 in a plane perpendicular to the side strips 12 by means of flexible inserts 15 made of rubber, located in the side openings of the strips 12. The flexible inserts 15 have positive influence on pressure distribution on the pins 11 and effectively attenuate excess dynamic forces in the rack.

A variant of the solution provides that between the segments of the rack 8 there are intermediate segments 21 jointly connected with the segments of the rack 8 by means of connectors 17 such that pins 18 and 19 of the connector are embedded in the oval openings 20 of the segment of the rack 8 and the intermediate segment 21. In normal operation along a straight line path, the oval openings 20 of the rack segment 8 and the intermediate segment 21 are widened along the lengthwise axis 16 of the rack in a direction towards the edge 32 of the rack segment 8 and the nearby edge 33 of the intermediate segment 21. Such manner of connection of jointly fastened rack segments 8 allows for quadruple decrease of maximal pitch length occuring as a result of the drawing apart of the rack segments during travel along curved portions of the travel path of the machine.

Another variant of the invention provides that the holder 25, fastening jointly the rack segment 8 to the travel path of the machine 1, possessing a work surface 26 for mating with drive wheel 7 and the pins 27 and 28 on which the side strips 12 are embedded jointly, such that the pin 28 of the holder 25 is fastened to the body 29 connected to the travel route of the machine 1 and abuts the side strip 12.

Such side fastening method permits the space beneath the rack to be clear of objects.

Another embodiment of the invention provides a good guide of the rack segment 8 in form of the rotary disk 24 positioned on bearings in the machine 1 beneath the drive wheel 7. Utilization of the guide in form of the rotary disk minimizes movement drag and loss of towing force.

Yet another embodiment of the invention provides that the holder 30 is located below the lengthwise axis 16 of the rack segment 8. Also the holder 35 fastening jointly the rack segment 36 to the body 13 of the travel route of the machine 1 is positioned between the strip 37 of the rack segment 36. The holder possesses an opening which in the pin 40 of the articulation is embedded. The pins 38 which mate with two toothed drive wheels 39 being positioned symmetrically outside the strips 37 of the rack segment 36.

The rack segments 36 are connected to each other by means of the connector 41 consisting of at least one pin of the rack 42. The connector 41 is jointly connected with the strips 37 of the rack segments 36 by means of the pins 43. The connector 41 possesses two oval openings 44 widened along the lengthwise axis 45 of the rack. On a straight line travel path of the machine 1 at normal working position of the rack, the oval openings 44 of the connector 41 are widened along the lengthwise axis 45 of the rack in a direction towards the single holders 35 fastening jointly the segments of the rack 36. Constant distance A between the lengthwise axis 46 of the rack segments 36 and the axis of rotation 46 of the toothed drive wheels 39 is maintained by the support surfaces 47 of the guide 23 of the machine 1, which surfaces 47 supporting engage the lower surfaces of the pins 38, projecting on the outside of the strips 37 of the rack.

Use of the rack segments with two symmetrically positioned pins 38, which mate simultaneously with two toothed drive wheels 39 permits the utilization of smaller diameter pins and permits the utilization of lesser force acting on the pins by the drive wheels.

Moreover, such a construction of the rack segments facilitates a simple construction of jointed holders and connectors of the rack segments.

I claim:

1. A rack for mounting on a segmented mine wall face conveyor or the like and for assisting the movement of a drum mining machine or the like along such segmented conveyor, the rack comprising:

a plurality of rack segments alinged substantially in an end-to-end relationship, each rack segment provided with a plurality of substantially equidistantly spaced pins oriented substantially perpendicularly to the longitudinal axis of the rack, the pins adapted for meshing with and driving engagement with a pinion or the like of the drum driving machine;

means for rotatably mounting each rack segment on the conveyor about a substantially horizontal axis, said mounting means connected to each rack segment at a point intermediate between the ends of the rack segment;

a connection link interposed between two adjacent rack segments and rotatably secured to each adjacent rack segment by means of an outermost pin of the rack segment about an axis substantially parallel to the axis of the spaced pins of each rock segment; and means for permitting limited extension and limited contraction of said connection link relative to each adjacent rack segment in a direction substantially along the longitudinal axis of the rack.

2. A rack according to claim 1 wherein said rotatable mounting means includes a holder or bracket rotatably fastened to a pin of the associated rack segment.

3. A rack according to claim 2 wherein said holder is rotatably fastened to the end of the pin, along a side of the associated rack segment.

4. A rack according to claim 2 wherein the pin to which the holder is rotatably fastened is disposed in at least one pinhole in the rack segment, and the pinhole is elongated in a direction substantially along the longitudinal axis of the rack.

5. A rack according to claim 4 wherein at least one flexible pad is inserted in an elongated portion of the pinhole, between the pin and the pinhole wall.

6. A rack according to claim 1 wherein the outermost pins of each rack segment extend through pinholes in the rack segment, which pinholes are elongated in a direction substantially along the longitudinal axis of the rack.

7. A rack according to claim 6 wherein at least one flexible pad is inserted in an elongated portion of each pinhole, between the pin and the pinhole wall.

8. A rack according to claim 1 wherein said connection link is rotatable about an axis substantially perpendicular to the longitudinal axis of the rack and substantially perpendicular to the axis of the pins.

* * * * *